US008297725B2

(12) United States Patent
Kim et al.

(10) Patent No.: US 8,297,725 B2
(45) Date of Patent: Oct. 30, 2012

(54) REFRIGERATOR DOOR OPENING DEVICE

(75) Inventors: Gang Hyun Kim, Gwangju-si (KR); Jin Ho Kim, Gwangju (KR); Seok Jun Son, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 437 days.

(21) Appl. No.: 12/385,073

(22) Filed: Mar. 30, 2009

(65) Prior Publication Data

US 2010/0141107 A1 Jun. 10, 2010

(30) Foreign Application Priority Data

Dec. 4, 2008 (KR) ..... 10-2008-0122426

(51) Int. Cl.

| | |
|---|---|
| ***A47B 96/04*** | (2006.01) |
| ***A47B 95/02*** | (2006.01) |
| ***A47B 88/00*** | (2006.01) |
| ***E05F 11/00*** | (2006.01) |

(52) U.S. Cl. ..... 312/405; 312/319.7; 312/324; 49/276

(58) Field of Classification Search ..... 312/405, 312/319.5–319.8, 326, 329, 324, 401, 405.1, 312/319.2, 296; 49/276, 277, 263, 278; 74/425; 62/131, 265, 441, 449; 292/DIG. 71, DIG. 72
See application file for complete search history.

(56) References Cited

U.S. PATENT DOCUMENTS

| | | | | |
|---|---|---|---|---|
| 655,502 | A * | 8/1900 | Messinger | 40/486 |
| 776,397 | A * | 11/1904 | Howard et al. | 49/116 |
| 1,410,901 | A * | 3/1922 | Elder | 318/9 |
| 4,320,934 | A * | 3/1982 | Rock et al. | 312/331 |
| 4,351,575 | A * | 9/1982 | Rock et al. | 384/18 |
| 5,483,769 | A * | 1/1996 | Zweili | 49/118 |
| 6,338,536 | B1 * | 1/2002 | Ueno et al. | 312/405 |
| 6,708,448 | B2 * | 3/2004 | Zappa | 49/41 |
| 2003/0122459 | A1 * | 7/2003 | Huber et al. | 312/319.6 |
| 2005/0269919 | A1 * | 12/2005 | Sambommatsu et al. | 312/319.5 |
| 2006/0097612 | A1 * | 5/2006 | Park | 312/405 |
| 2006/0107597 | A1 * | 5/2006 | Jin et al. | 49/149 |
| 2006/0261220 | A1 * | 11/2006 | Lee et al. | 248/27.1 |

(Continued)

FOREIGN PATENT DOCUMENTS

EP 1911921 A2 * 4/2008

(Continued)

*Primary Examiner* — David Dunn
*Assistant Examiner* — Ryan A Doyle
(74) *Attorney, Agent, or Firm* — Staas & Halsey LLP

(57) ABSTRACT

A refrigerator equipped with a door opening device opening doors by driving a motor and a method of controlling the same. In the method of controlling the refrigerator includes a door opening device including a plurality of sliding bars selectively opening first and second doors, a motor opening the first door or the second door by moving back and forth the sliding bars in directions opposite to each other, a plurality of position detectors detecting at least one protrusion provided at one side of the sliding bar, a switch unit inputting door opening signals, and a controller controlling operation of the first door and the second door according to the door opening signals. If door opening signals used to open the first and second doors, the door opening device is controlled so that the first and second doors are easily open/closed.

5 Claims, 16 Drawing Sheets

U.S. PATENT DOCUMENTS

2007/0295020 A1* 12/2007 Lee ..... 62/259.2
2008/0066481 A1* 3/2008 An et al. ..... 62/265
2008/0083243 A1* 4/2008 Lee et al. ..... 62/446
2008/0134698 A1* 6/2008 Cho et al. ..... 62/127
2008/0288113 A1* 11/2008 Nishio ..... 700/275
2011/0016907 A1* 1/2011 Kang et al. ..... 62/449
2011/0083461 A1* 4/2011 Kim ..... 62/264

FOREIGN PATENT DOCUMENTS

KR 10-2008-0053743 6/2008

* cited by examiner

FIG. 4

| | 1ST POSITION DETECTOR | 2ND POSITION DETECTOR |
|---|---|---|
| WAITING STATE | DETECTED | DETECTED |
| OPEN STATE OF 1ST DOOR | DETECTED | NOT DETECTED |
| OPEN STATE OF 2ND DOOR | NOT DETECTED | DETECTED |
| OPEN STATE OF CERTAIN DOOR | NOT DETECTED | NOT DETECTED |

FIG. 8

| | 1STPOSITION DETECTOR | 2NDPOSITION DETECTOR | 3RDPOSITION DETECTOR |
|---|---|---|---|
| WAITING STATE | DETECTED | DETECTED | NOT DETECTED |
| MAXIMUM OPEN STATE (A) OF 1ST DOOR | DETECTED | NOT DETECTED | NOT DETECTED |
| OPEN STATE (B) OF 1ST DOOR | NOT DETECTED | NOT DETECTED | NOT DETECTED |
| MAXIMUM OPEN STATE (A) OF 2ND DOOR | NOT DETECTED | DETECTED | DETECTED |
| OPEN STATE (B) OF 2ND DOOR | NOT DETECTED | NOT DETECTED | DETECTED |

REFRIGERATOR DOOR OPENING DEVICE

CROSS-REFERENCE TO RELATED APPLICATIONS

This application claims the benefit of Korean Patent Application No. 10-2008-0122426 filed on Dec. 4, 2008, in the Korean Intellectual Property Office, the disclosure of which is incorporated herein by reference.

BACKGROUND

1. Field

The present invention relates to a refrigerator and a method of controlling the same. More particularly, the present invention relates to a refrigerator equipped with a door opening device enabling a user to easily open a door of the refrigerator and a method of controlling the refrigerator.

2. Description of the Related Art

Generally, a refrigerator cools articles stored therein through a cooling cycle of a compressor, a condenser, and an evaporator. The refrigerator is provided therein with a storage compartment to allow a user to store and take out the articles in the refrigerator. The refrigerator includes at least one storage compartment according to the capacity of the refrigerator. For example, the storage compartment may be divided into two compartments, such as a cooling compartment and a refrigerating compartment, or may be divided into four compartments, such as a cooling compartment, a refrigerating compartment, an auxiliary cooling compartment, and an auxiliary refrigerating compartment.

Meanwhile, the refrigerator having at least one storage compartment includes a door, which opens/closes the storage compartment. The door is divided into a hinge coupling type door that is rotatably open/closed relative to the storage compartment and a drawer type door that is open/closed relative to the storage compartment like a drawer.

Meanwhile, typically, a user must pull a door of a refrigerator when the user wants to manually open the door. In addition, when the user wants to close the door, the user must push the door using a hand or a foot such that the door can be closed by the weight thereof.

SUMMARY

Accordingly, it is an aspect of the present invention to provide a refrigerator and a method of controlling the same, capable of automatically opening/closing a door using a motor.

In addition, it is another aspect of the present invention to provide a refrigerator and a method of controlling the same, capable of reducing noise in the process of changing a direction of a motor when a door is open/closed.

Further, it is still another aspect of the present invention to provide a refrigerator and a method of controlling the same, capable of setting a door in an initial position when the refrigerator is powered on.

Additional aspects and/or advantages of the invention will be set forth in part in the description which follows and, in part, will be apparent from the description, or may be learned by practice of the invention.

The foregoing and/or other aspects of the present invention are achieved by providing a refrigerator including first and second doors which open/close first and second storage compartments defined in a body, respectively, and a door opening device. The door opening device includes a plurality of sliding bars which selectively open the first and second doors, and a motor which opens/closes the first door or the second door by moving back and forth the sliding bars in directions opposite to each other.

The door opening device may further include a switch unit inputting a door opening signal used to open the first door or the second door.

The door opening device may further include a controller controlling the first door or the second door to be open according to the door opening signal input to the switch unit.

The door opening device may further include a plurality of position detectors detecting at least one protrusion provided at one side of the sliding bars.

The door opening device may further include a display unit displaying failure of the door opening device.

According to another aspect of the present invention, there is provided a method of controlling a refrigerator including a door opening device, which includes first and second doors opening/closing first and second storage compartments defined in a body, a plurality of sliding bars selectively opening the first and second doors, a motor opening the first door or the second door by moving back and forth the sliding bars in directions opposite to each other, a plurality of position detectors detecting at least one protrusion provided in one side of the sliding bars, a switch unit inputting door opening signals, and a controller controlling operation of the first and second doors according to the door opening signals, and the method includes opening/closing the first and second doors by controlling the door opening device if the door opening signals are input in order to open the first door or the second door.

The sliding bar may be moved by driving the motor for a first set time sufficient for enabling the at least one protrusion to deviate from a detection region of the position detector if the door opening signals are input.

A time point, at which the at least one protrusion enters the detection region of the position detector, is recognized if the first set time elapses.

The sliding bar may be moved by driving the motor for a second set time sufficient for enabling the at least one protrusion to enter a reliable detection region of the position detector if the at least one protrusion has entered the detection region of the position detector.

The motor may be stopped if the second set time elapses, so that the first door or the second door maintains an open state for a third set time.

The sliding bar may be moved by driving the motor for a fourth set time sufficient for enabling the at least one protrusion to deviate from the detection region of the position detector if the third set time elapses.

The time point, at which the at least one protrusion enters the detection region of the position detector, is recognized if the fourth set time elapses.

The sliding bar may be moved by driving the motor for a fifth set time sufficient for enabling the at least one protrusion to enter the reliable detection region of the position detector if the at least one protrusion has entered the detection region of the position detector.

If the door opening signals of the first and second doors are simultaneously input, the controller may determine an input sequence of the door opening signals to recognize only the door opening signal that is primarily input such that one of the first and second doors corresponding to the primary door opening signal is open.

If the door opening signals of the first and second doors are simultaneously input, the controller may not recognize all the door opening signal, or recognizes only the door opening signal of a preset door.

If the door opening signal for one of the first and second doors is input when a remaining one door is open/closed, the door opening signal may not be recognized.

According to still another aspect of the present invention, there is provided a method of controlling a refrigerator equipped with first and second doors opening/closing first and second storage compartments partitioned in a body. The refrigerator includes a door opening device including a plurality of sliding bars selectively opening the first and second doors, a motor opening the first door or the second door by moving back and forth the sliding bars in directions opposite to each other, a plurality of position detectors detecting at least one protrusion provided at one side of the sliding bar, a switch unit inputting door opening signals, and a controller controlling operation of the first door and the second door according to the door opening signals. The method of controlling the refrigerator includes detecting a position of the at least one protrusion if the refrigerator is powered on, and controlling the first and second doors to be closed according to a position of the at least one protrusion.

The method may further include rotating the motor in one preset direction if the position of the at least one protrusion is not detected.

The method may further include controlling the first and second doors such that the first and second doors are closed according to the position of the at least one protrusion if the position of the at least one protrusion is detected due to the rotating of the motor.

The method may further include recognizing that the at least one protrusion is placed at a preset position if the at least one position of the protrusion is not detected.

The method may further include controlling the first and second doors such that the first and second doors are closed according to the at least one position of the protrusion.

If the position of the at least one protrusion is not detected for a predetermined time when the first and second doors are controlled to be closed, the door opening device may be regarded as failed.

The door opening device may further include a display unit, and the display unit displays failure of the door opening device if the door opening device is regarded as failed.

As described above, according to one aspect, a plurality of doors can be open by moving two sliding bars using one motor, so that the manufacturing cost can be reduced.

According to another aspect, when a door is open due to the rotation of the motor, or the door position is changed from the maximum open state to a closed state, the operation of the door is performed after a predetermined time has elapsed, so that noise can be reduced when the door is open/closed.

According to still another aspect, when power is turned off and then turn on due to cut-off of electric current, a state of the door can be exactly determined by the position detectors, so that the door can return to a waiting state without an unnecessary operation.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 4 is a view showing a table representing the detection state of position detectors based on the open state of doors according to the first embodiment;

FIG. 8 is a table showing the detection state of position detectors when a door is open according to the second embodiment.

DETAILED DESCRIPTION OF EMBODIMENTS

Figure 1:
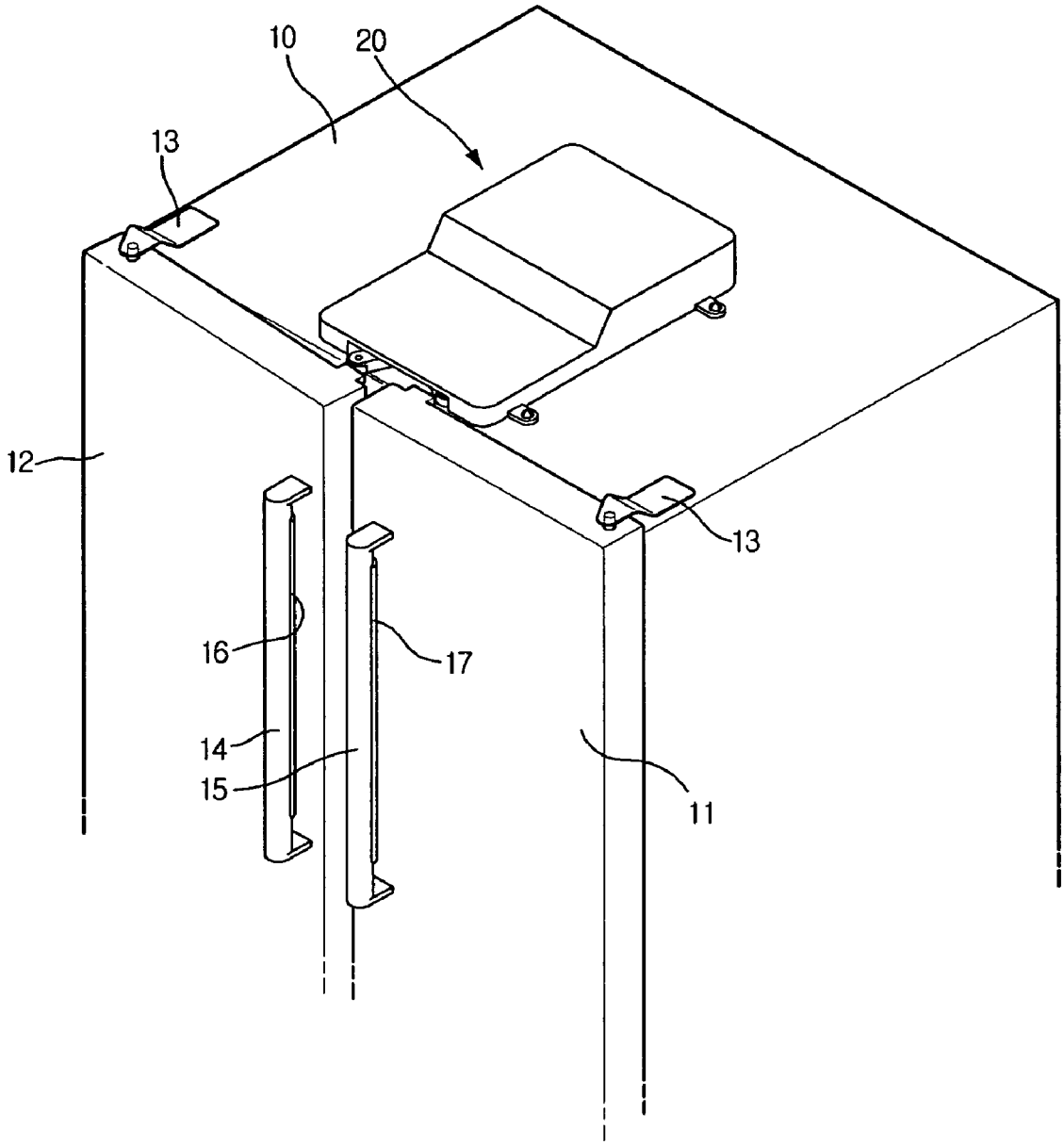
FIG. 1 is a view showing a refrigerator employing a door opening device according to one embodiment.

Reference will now be made in detail to the embodiments, examples of which are illustrated in the accompanying drawings, wherein like reference numerals refer to the like elements. The embodiments are described below by referring to the figures.

FIG. 1 is a view showing a refrigerator employing a door opening device 20 according to one embodiment.

As shown in FIG. 1, the refrigerator according to one embodiment includes a body 10 divided into a first storage compartment (not shown) and a second compartment (not shown). First and second doors 11 and 12 are installed at both sides of a front surface of the body 10 to open/close the first and second storage compartments. Generally, in such a refrigerator, the first storage compartment serves as a cooling compartment, and the second storage compartment serves as a refrigerating compartment. Upper and lower portions of the first and second doors 11 and 12 are pivotally coupled to the body 10 by a hinge assembly 13. In addition, first and second handles 14 and 15 are provided on front surfaces of the first and second doors 11 and 12.

The door opening device 20 may be mounted on a top surface of the body 10 to push the upper portions of the first and second doors 11 and 12 forward and open the first and second doors 11 and 12, so that a user can easily open the first and second doors 11 and 12.

Figure 2:
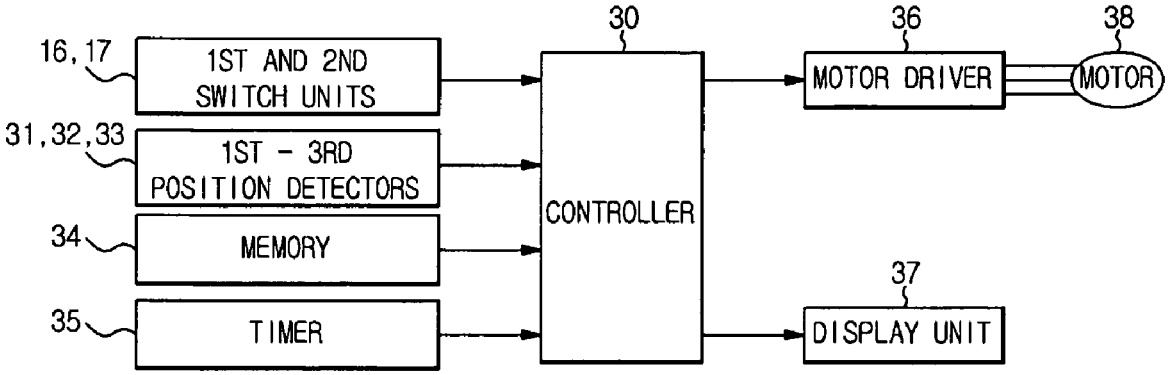
FIG. 2 is a control block diagram showing the door opening device according to one embodiment.

FIG. 2 is a control block diagram showing the door opening device 20 according to one embodiment.

As shown in FIG. 2, the door opening device 20 includes first and second switch units 16 and 17 allowing a user to input a door opening signal, first, second, and third position detectors 31, 32, and 33 detecting positions of first and second sliding bars 40 and 41, a memory 34 storing a program to control the operation of a motor 38, a timer 35 measuring a driving time of the motor 38, a controller 30 controlling the driving of the motor 38 using information from the first to third position detectors 31 to 33 and the timer 35, a motor driver 36 driving the motor 38 under the control of the controller 30, and a display unit 37 displaying the failure of the door opening device 20.

The first and second switch units 16 and 17 are provided at the first and second handles 14 and 15 of the first and second doors 11 and 12 to allow a user to control the operation of the motor 38. The first and second switch units 16 and 17 may be detectors that detect touch of the user on the first and second handles 14 and 15, or power switches that directly turn on/off power applied to the motor 38.

The first to third position detectors 31 to 33 may detect a rotation position of the motor 38, that is, a position of the first and second sliding bars 40 and 41. The first to third position detectors 31, 32, and 33 may detect the rotation position of the motor 38 by detecting first, second, and third protrusions 42, 43, and 44. In addition, the first to third position detectors 31 to 33 may be a typical optical sensor. According to the present embodiment, the first to third position detectors 31 to 33 are turned on if a signal phase is changed due to the first and second protrusions 42 and 43, and turned off if the signal phase is not changed.

The memory 34 stores a program to control the operation of the motor 38, and the timer 35 can measure the driving time of the motor 38.

The controller 30 can transmit an operational control signal for the motor 38 to the motor driver 36 according to the program previously stored in the memory 34 by using door opening signals of the first and second switches 16 and 17, information delivered from the first to third position detectors 31 to 33, and the timer 35.

The display unit 37 may be a display (not shown) positioned on the front surface of the body 10 of the refrigerator, and can display the failure of the door opening device 20.

Figure 3A:
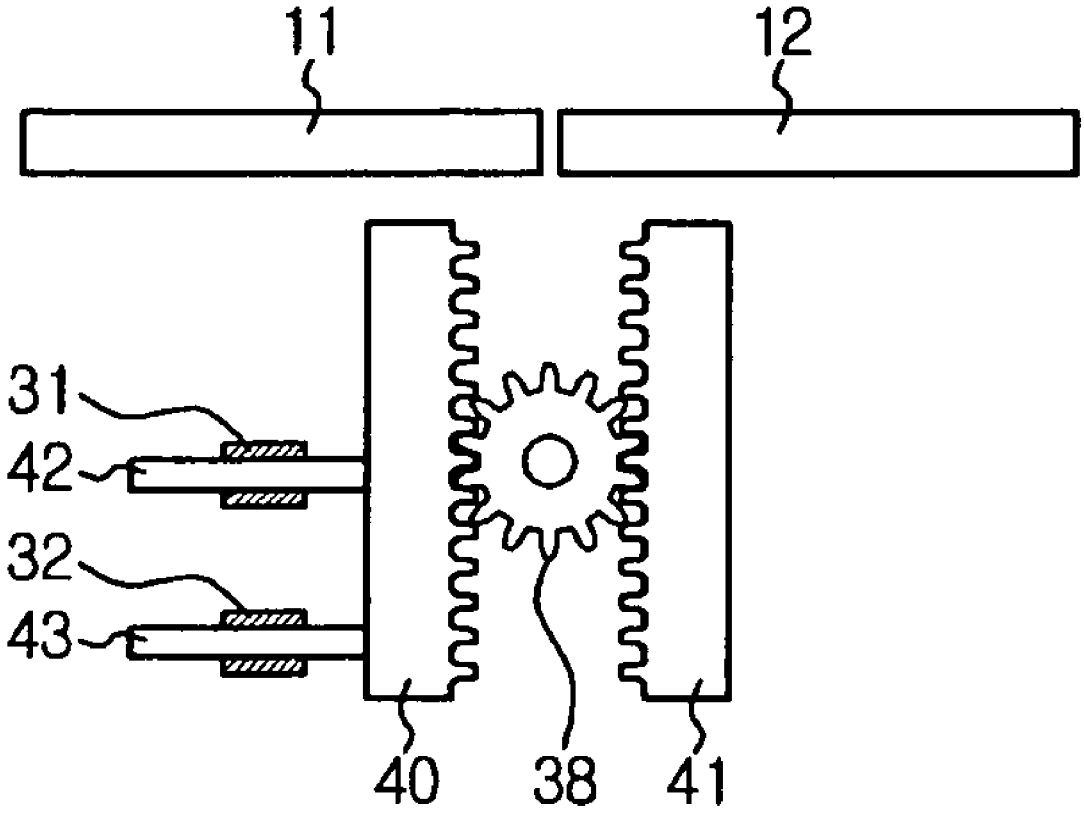
FIGS. 3A to 3C are schematic views showing a door opening device according to a first embodiment.
Figure 3B:
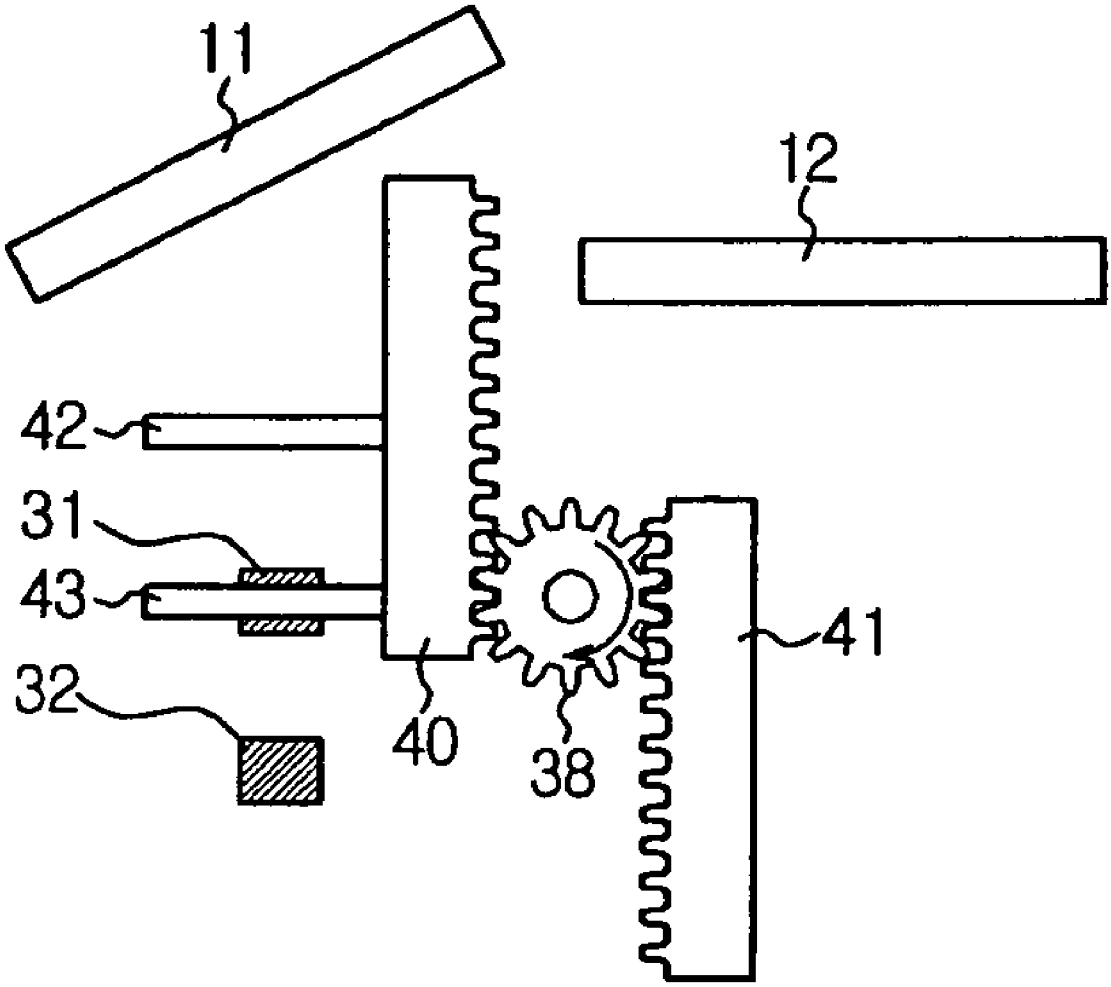
Figure 3C:
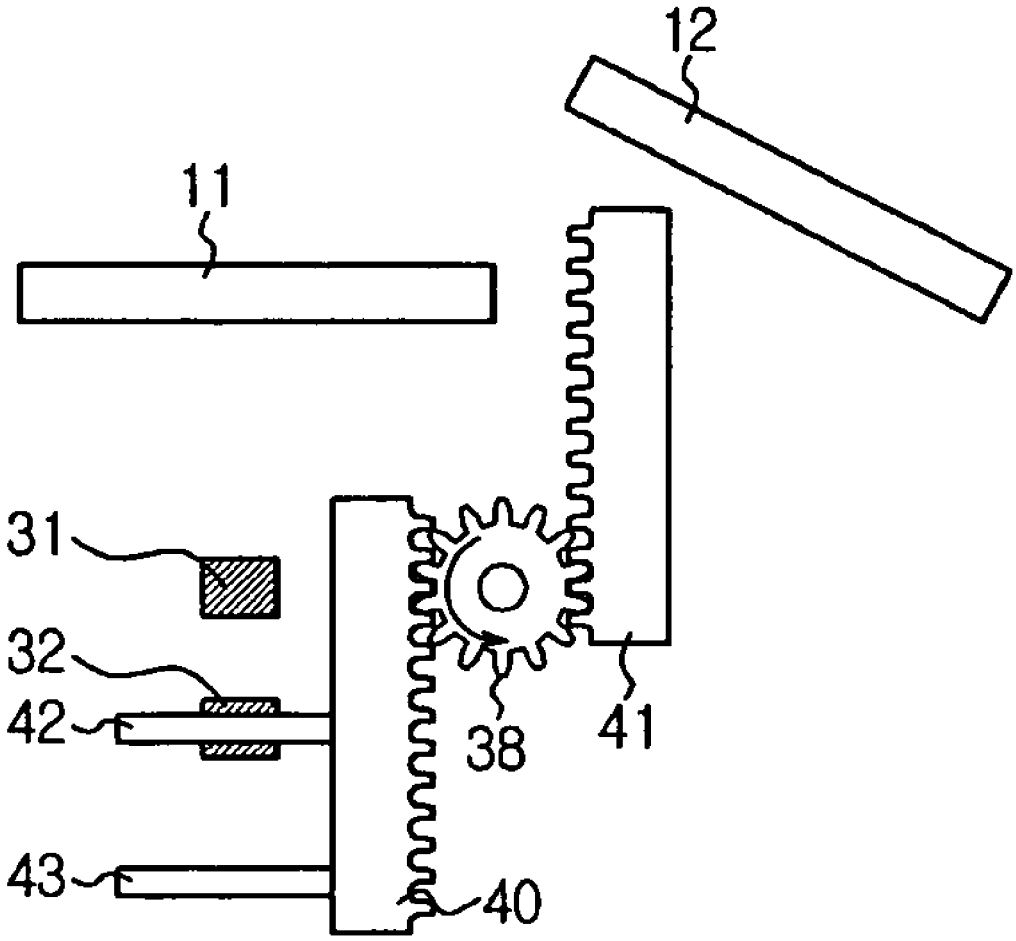

FIGS. 3A to 3C are schematic views showing the door opening device 20 according to a first embodiment of the present invention.

As shown in FIG. 3A, the door opening device 20 according to the first embodiment includes the first and second sliding bars 40 and 41 capable of selectively opening the two first and second doors 11 and 12, the motor 38 moving the sliding first and second bars 40 and 41, the first and second position detectors 31 and 32 capable of detecting the positions of the first and second sliding bars 40 and 41, and the first and second protrusions 42 and 43 protruding from one side of the first sliding bar 40 to be detected by the first and second position detectors 31 and 32.

The first and second sliding bars 40 and 41 are geared with both sides of the motor 38 (e.g., a rack and a pinion assembly) to selectively push the two first and second doors 11 and 12. The two first and second protrusions 42 and 43 are provided on the first sliding bar 40 to detect the position of the first sliding bar 40 by the first and second position detectors 31 and 32. Meanwhile, as shown in FIG. 3A, although the two first and second protrusions 42 and 43 are provided at one side of the first sliding bar 40, the two first and second protrusions 42 and 43 may be provided at one side of the second sliding bar 41.

The motor 38 is geared with the first and second sliding bars 40 and 41 (e.g., a rack and a pinion assembly) to rotate. When the motor 38 rotates in a first direction (clockwise), the first door 11 can be open by the first sliding bar 40. When the motor 38 rotates in a second direction (counterclockwise), the second door 12 can be open by the second sliding bar 41.

The first and second position detectors 31 and 32 may be installed in order to detect the rotation position of the motor 38, that is, the position of the first sliding bar 40. The first and second position detectors 31 and 32 detect the two first and second protrusions 42 and 43 of the first sliding bar 40 through an optical sensor (not shown) to detect the rotation position of the motor 38. In addition, the first and second position detectors 31 and 32 include typical optical sensors. According to one embodiment, the first and second position detectors 31 and 32 are turned on if the signal phase is changed by the two first and second protrusions 42 and 43, and turned off if the signal phase is not changed.

Meanwhile, the present invention is not limited to the first and second position detectors 31 and 32, but can employ a lead switch to detect the positions of the first and second protrusions 42 and 43 and a limit switch to detect the positions of the first and second protrusions 42 and 43 in the contact with the first and second protrusions 42 and 43.

Hereinafter, the operation of the door opening device 20 will be described with reference to FIGS. 3B and 3C.

If a user grasps or pulls the second handle 15 of the first door 11 in order to open the first door 11, the motor 38 operates with the manipulation of the second switch unit 17. In this case, as shown in FIG. 3B, the motor 38 rotates in the first direction (clockwise) to push the first sliding bar 40 geared with the motor 38 (e.g., a rack and a pinion assembly) forward so that the first door 11 can be opened. If the first position detector 31 detects the second protrusion 43 of the first sliding bar 40, and the second position detector 32 does not detect any protrusion, it is determined that the first door 11 is at the maximum open state, and the motor 38 is stopped. Meanwhile, according to one embodiment, when open commands of the first and second doors 11 and 12 are issued, the first and second doors 11 and 12 are open through the driving of the motor 38, and then, when a predetermined time elapses, the first and second doors 11 and 12 are closed. Details thereof will be described later.

In addition, if the user grasps or pulls the first handle 14 of the second door 12 in order to open the second door 12, the motor 38 rotates in the second direction (counterclockwise) with the manipulation of the first switch unit 16 to push the second sliding bar 41 forward, so that the second door 12 is open. In addition, if the second position detector 32 detects the first protrusion 42, and the first position detector 31 does not detect any protrusion, it is determined that the door 12 has the maximum open state, and the motor 38 is stopped.

FIG. 4 is a view showing a table representing the detection state of the first and second position detectors 31 and 32 based on the open state of the first and second doors 11 and 12 according to the first embodiment.

As shown in FIG. 4, when the first and second position detectors 31 and 32 detect all of the first and second protrusions 42 and 43, the first and second doors 11 and 12 of the refrigerator are in a waiting state, that is, a closed state.

In addition, if the first position detector 31 detects a protrusion, and the second position detector 32 does not detect a protrusion, the controller 30 determines that the first door 11 is open. In contrast, if the first position detector 31 does not any protrusion, and the second position detector 32 detects a protrusion, the controller 30 determines that the second door 12 is open.

If both of the first and second position detectors 31 and 32 do not detect the first and second protrusions 42 and 43, the controller 30 may determine that the first door 11 or the second door 12 is open or is being opened.

Figure 5A:
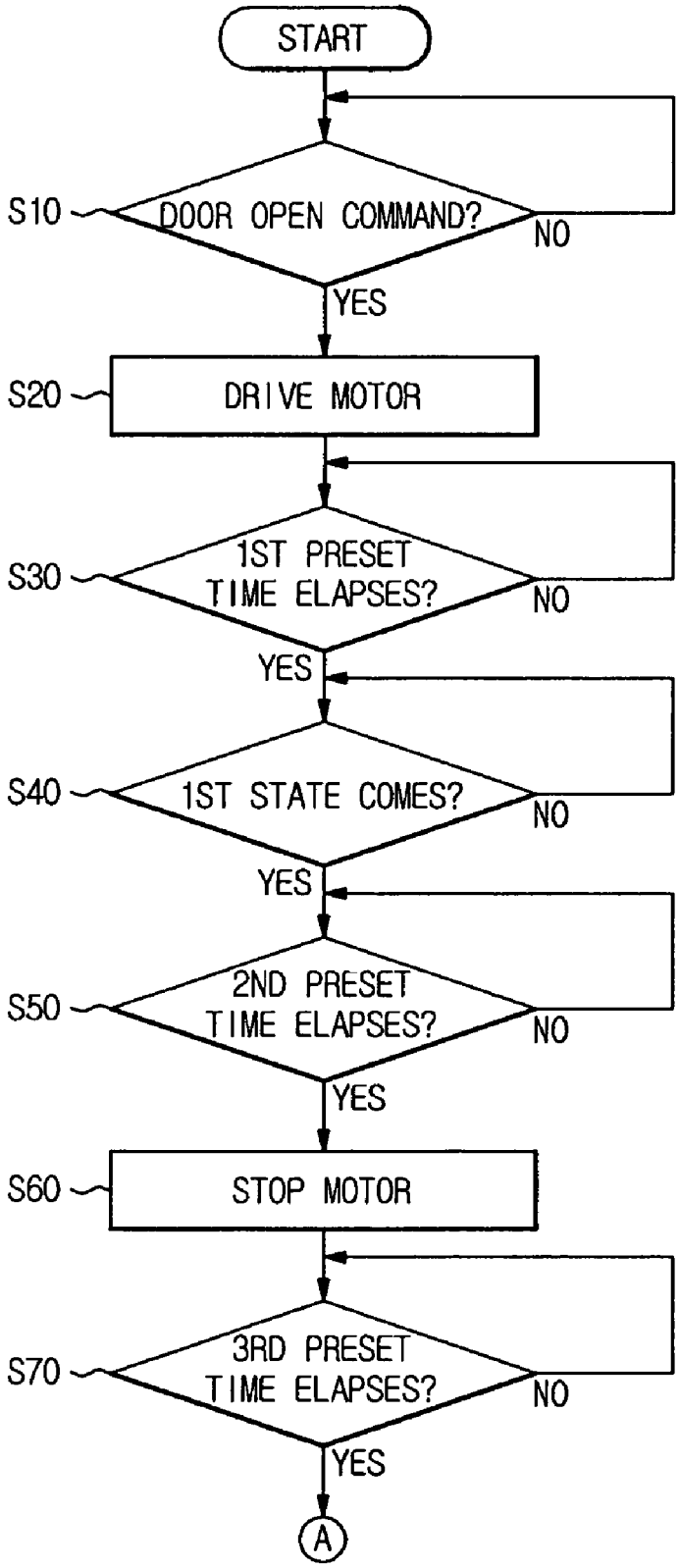
FIGS. 5A and 5B are flowcharts showing the control procedure of the door opening device according to the first embodiment.
Figure 5B:
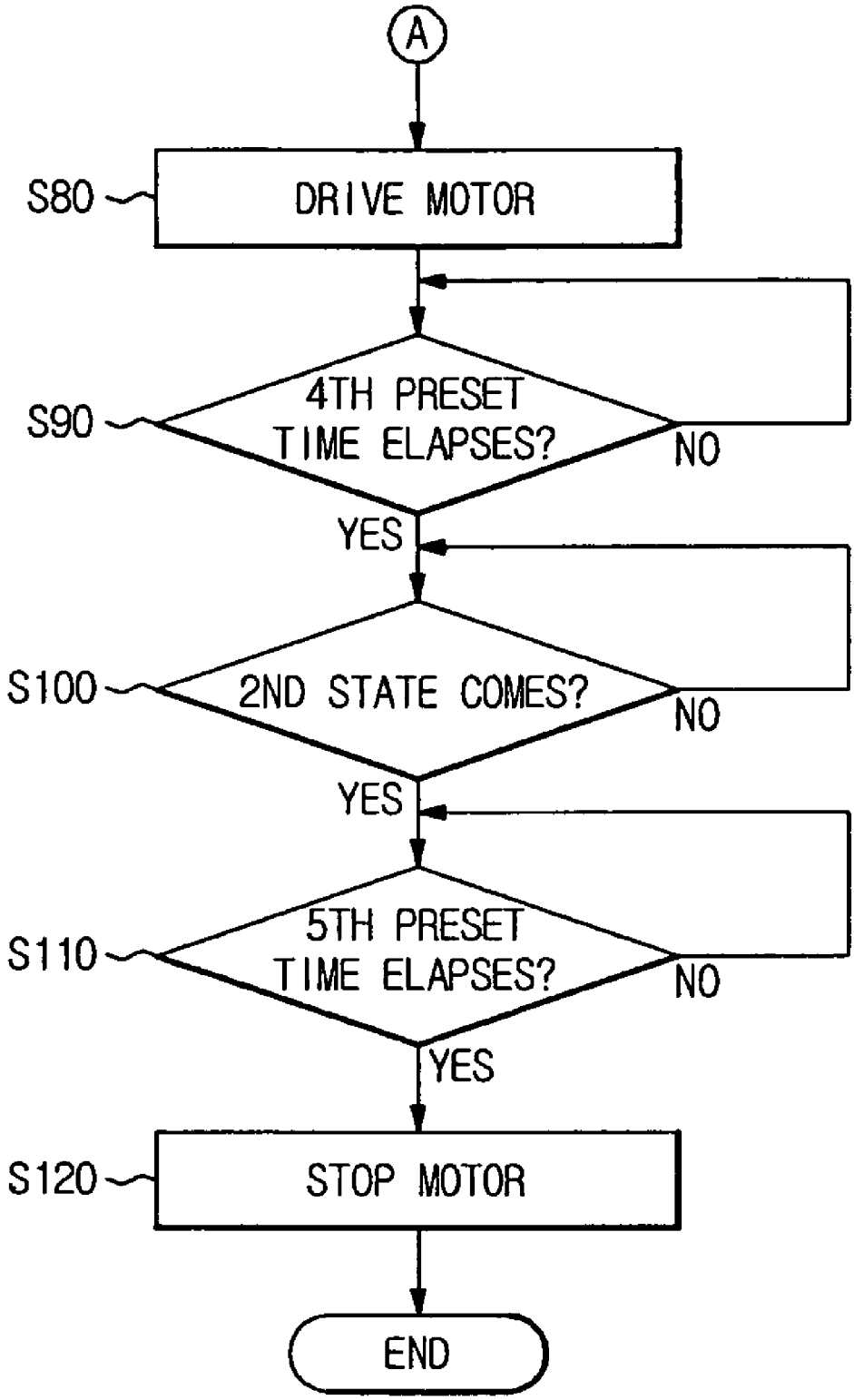

FIGS. 5A and 5B are flowcharts showing the control procedure of the door opening device 20 according to the first embodiment.

As shown in FIG. 5A, if an open command of the first door 11 or the second door 12 of the refrigerator according to one embodiment is input, the motor 38 is driven. In other words, if a user grasps or pulls the first or second switch unit 16 or 17 provided on the first or second handle 14 or 15 of the first or second door 11 or 12 to control the operation of the motor 38, the motor 38 is driven with the operation of the first or second switch unit 16 or 17. In detail, if the user manipulates the second switch 17 provided on the second handle 15 of the first door 11, the motor 38 rotates in the first direction (clockwise). If the user manipulates the first switch 16 provided on the first handle 14, the motor 38 rotates in the second direction (counterclockwise) (operation S10 and S20).

Subsequently, if the motor 38 is driven due to the user manipulation of the first switch unit 16 or the second switch unit 17, the controller 30 measures a time, in which the motor 38 is driven, to determine if a first preset time elapses. The first preset time is previously stored in the memory 34, and is obtained by experimentally calculating a time spent until the first and second protrusions 42 and 43 of the first sliding bar 40 deviate from detection regions of the first and second position detectors 31 and 32 after the motor 38 in the waiting state is driven (operation S30).

Next, if the controller 30 determines that the first preset time has elapsed in operation S30, the controller 30 determines if a first state comes. In this case, the first state means an initial time point at which the first protrusion 42 enters the detection region of the second position detector 32 or the second protrusion 43 enters the detection region of the first position detector 31 due to continuous rotation of the motor 38 after the first and second protrusions 42 and 43 of the first sliding bar 40 have deviated from the detection regions of the first and second position detectors 31 and 32 (operation S40).

Thereafter, the controller 30 determines if a second preset time elapses after the first state is determined in operation S40. The second preset time is previously stored in the memory 34, and means a time spent until the first protrusion 42 of the first sliding bar 40 or the second protrusion 43 moves into a reliable detection region of the second position sensor 32 or the first position sensor 31 from the initial time point at which the first protrusion 42 enters the detection region of the second position detector 32 or the second protrusion 43 enters the detection region of the first position detector 31 (operation S50).

Next, if the controller 30 determines that the second preset time has elapsed in operation S50, the controller 30 stops the motor 38 and determines if a third preset time elapses. In this case, the third preset time is previously stored in the memory 34, and means a time, in which the motor 38 is stopped, in order to reduce noise created when the direction of the motor 38 is changed (operations S60 and S70).

As shown in FIG. 5B, if the third preset time has elapsed in operation S70, the controller 30 drives the motor 38. In other words, the controller 30 rotates the motor 38 in directions opposite to a direction, in which the motor 38 has rotated in operations S20 to S50, to commence to close the first door 11 or the second door 12 again (operation S80).

Then, if the motor 38 is driven, the controller 30 measures the driving time of the motor 38 to determine if a fourth preset time has elapsed. The fourth preset time is previously stored in the memory 34. In addition, the fourth preset time is obtained by experimentally calculating a time spent until the motor 38 is driven in a door open state so that the first protrusion 42 or the second protrusion 43 of the sliding bar 40 deviates from the detection region of the second position detector 32 or the first position detector 31 (operation S90).

Thereafter, if the fourth preset time has elapsed in operation S90, the controller 30 determines if a second state comes. The second state means an initial time point at which the first and second protrusions 42 and 43 of the first sliding bar 30 enter the detection regions of the first and second position detectors 31 and 32 due to the continuous rotation of the motor 38 after the first protrusion 42 or the second protrusion has deviated from the detection region of the second position detector 32 or the first position detector 31 (operation S100).

Then, the controller 30 determines if a fifth preset time has elapsed after the second state has come in operation S100. The fifth preset time is previously stored in the memory 34, and means a time spent until the first protrusion 42 or the second protrusion 43 of the first sliding bar 40 moves into the reliable region of the second position detector 32 or the first position detector 31 from the initial time point at which the first protrusion 42 or the second protrusion 43 enters the detection region of the second position detector 32 or the first position detector 31 (operation S110).

Thereafter, if the fifth preset time has elapsed in operation S110, the controller 30 stops the motor 38 to terminate a door opening/closing operation (operation S120).

Meanwhile, the above operational procedure prevents the motor 38 from erroneously operating due to chattering. The chattering refers to a phenomenon in which an electrical contact is abnormally turned on/off for a very short time due to mechanical vibration. According to the present embodiment, the above operation procedure is performed in order to drive the motor 38 for several times previously stored in the memory 34 and open/close the first door 11 or the second door 12, so that the motor 38 moves the sliding bar 40 or 41 into a reliable detection region of the position detectors 31 and 32.

Figure 6:
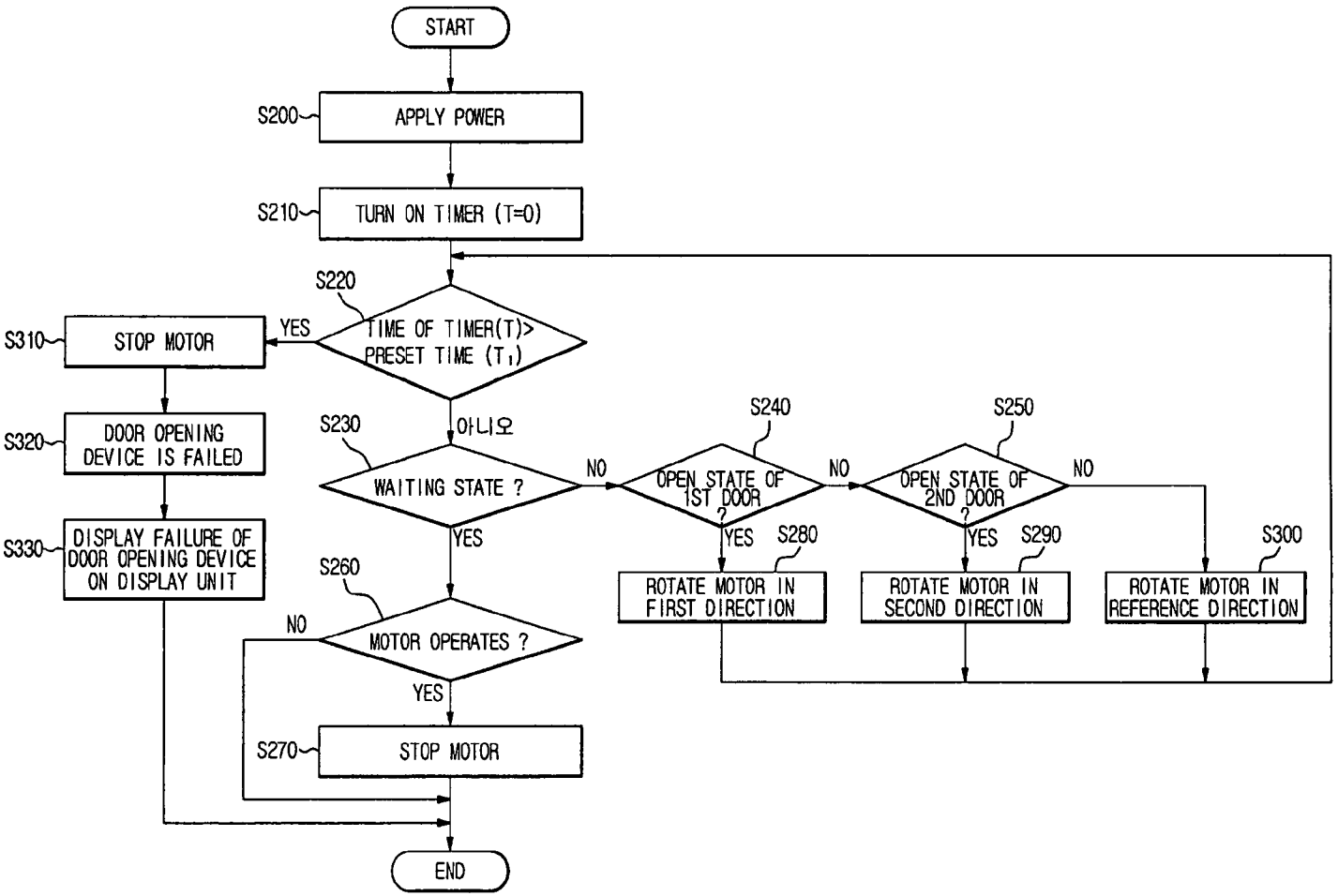
FIG. 6 is a flowchart showing an initialization operation when the door opening device is powered on according to the first embodiment.

FIG. 6 is a flowchart showing an initialization operation when the door opening device 20 is powered on according to the first embodiment.

As shown in FIG. 6, if power is applied to the refrigerator, the controller 30 turns on the timer 35 to set time (T) to '0' (operations S200 and S210).

Then, the controller 30 determines if the time (T) of the timer 35 exceeds a preset time T. If the time (T) does not exceed the preset time T, the controller 30 determines if the first door 11 or the second door 12 of the refrigerator stays in a waiting state. In other words, the controller 30 determines if the first and second protrusions 42 and 43 are simultaneously detected by the second and first position detectors 32 and 31, respectively, to determine if both of the first and second doors 11 and 12 are closed (operations S220 and S230).

Thereafter, if the first door 11 or the second door 12 of the refrigerator is in the waiting state in operation S230 when power is applied to the first door 11 or the second door 12 of the refrigerator, the controller 30 determines the operational state of the motor 38. If the motor 38 is driven, the controller 30 stops the operation of the motor 38 to terminate the initialization operation. However, if the first door 11 or the second door 12 is in the waiting state when power is applied to the refrigerator, since the motor 38 is in a stop state, the initialization operation is instantly terminated (operations S260 and S270).

Meanwhile, if the first door 11 or the second door 12 is not in the waiting state in operation S230, the controller 30 determines if the first door 11 is open. In other words, the controller 30 determines if the second protrusion 43 of the sliding bar 40 is detected by the first position detector 31. However, the first and second position detectors 31 and 32 do not detect the type of the first and second protrusions 42 and 43. Accordingly, if the first position detector 31 detects a protrusion, and the second position detector 32 does not detect a protrusion, the controller 30 determines that the first door 11 is open through the program previously stored in the memory 34 (operation S240).

Thereafter, if the controller 30 determines that the first door 11 is open in operation S240, the controller 30 rotates the motor 38 in the second direction (counterclockwise) to move the first sliding bar 40 such that the first door 11 is closed (operation S280).

Then, if the controller 30 determines that the first door 11 is not open in operation S240, the controller 30 determines if the second door 12 is open. In other words, the controller 30 determines that the first protrusion 42 of the first sliding bar 40 is detected by the second position detector 32. However, the first and second position detectors 31 and 32 do not detect the type of the protrusions 42 and 43. Accordingly, if the second position detector 32 detects the protrusion, and the first position detector 31 does not detect the protrusion, the controller 30 determines that the second door 12 is open through the program previously stored in the memory 34 (operation S250).

Thereafter, if the controller 30 determines that the second door 12 is open in operation S250, the controller 30 rotates the motor 38 in the first direction (clockwise) to move the first sliding bar 40 such that the second door 12 is closed (operation S290).

Meanwhile, if the controller 30 determines that the first door 11 or the second door 12 is not in any one of the waiting state, a first door open state, and a second door open state in operations S230 to S250, the controller 30 rotates the motor 38 in a reference direction stored in the memory 34. In other words, in the case of an open state of a certain door as shown in the table of FIG. 4, that is, in the case in which the first and second position detectors 31 and 32 do not detect any protrusion, the controller 30 rotates the motor 38 in a preset direction and returns to operation S220 to determine the state of the first door 11 or the second door 12 (operation S300).

Thereafter, if the motor 38 is rotated in operations S280 to S300, the controller 30 returns to operation S220 to determine if the time T of the timer 45 exceeds the preset time T1. If the time T of the timer 45 does not the preset time T1, the controller 30 determines if the doors 11 and 12 are adjusted to the waiting state due to the rotation of the motor 38. In this case, if the doors 11 and 12 do not become the waiting state until the time T of the timer 45 exceeds the preset time T1, the controller 30 stops the operation of the motor 38, determines that the door opening device 20 is failed, and displays the failure of the door opening device 20 on the display unit 37 (operations S310 to S330).

If the door 11 or 12 becomes the waiting state within the preset time T1 through the above procedure, the controller 30 determines the operational state of the motor 38 and then stops the motor 38 to terminate the initialization operation (operations S260 and S270).

FIGS. 7A to 7E are sectional views schematically showing the door opening device 20 according to a second embodiment, and FIG. 8 is a table showing detection states of position detectors as a door is open according to the second embodiment of the present invention. Meanwhile, the same reference numerals will be assigned to elements identical to those of FIG. 3A.

Figure 7A:
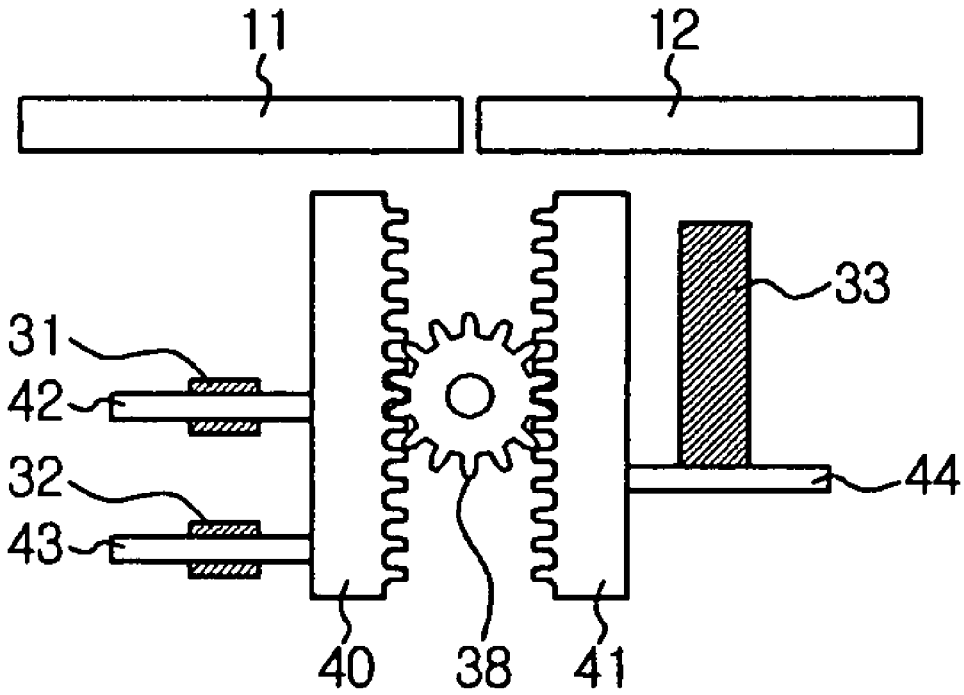
FIGS. 7A to 7E are sectional views schematically showing a door opening device according to a second embodiment.

As shown in FIG. 7A, a door opening device 20 according to the second embodiment includes first and second sliding bars 40 and 41 capable of selectively opening two first and second doors 11 and 12, a motor 38 moving the first and second sliding bars 40 and 41, first, second, and third position detectors 31, 32, and 33 capable of detecting positions of the first and second sliding bars 40 and 41, and first, second, and third protrusions 42, 43, and 44 protruding from one sides of the first and second sliding bars 40 and 41 to be detected by the first to third position detectors 31 to 33.

The sliding bars 40 and 41 are geared with both sides of the motor 38 (e.g., a rack and a pinion assembly) such that the two first and second doors 11 and 12 can be selectively pushed, and the two first and second protrusions 42 and 43 are provided on the first sliding bar 40 to be detected by the first and second position detectors 31 and 32. One protrusion 44 is provided on the second sliding bar 41, so that the position of the second sliding bar 41 can be detected by the third position detector 33.

The motor 38 is geared with the first and second sliding bars 40 and 41 (e.g., a rack and a pinion assembly) to rotate. When the motor 30 rotates in a first direction (clockwise), the first door 11 is open by the first sliding bar 40. When the motor 38 rotates in a second direction (counterclockwise), the second door 12 can be open by the second sliding bar 41.

The first to third position detectors 31 to 33 detect the rotation position of the motor 38, that is, positions of the first and second sliding bars 40 and 41. In detail, the first to third position detectors 31 to 33 can detect magnets (not shown) provided in the three protrusions 42, 43, and 44 to detect the rotation position of the motor 38.

Meanwhile, when both of the two first and second doors 11 and 12 are closed, that is, when both of the two first and second doors 11 and 12 are in a waiting state, the first and second position detectors 31 and 32 detect the second and third protrusions 42 and 43, and the third position detector 33 does not detect the third protrusion 44.

Hereinafter, the operation of the door opening device 20 will be described with reference to FIGS. 7B to 7E.

Figure 7B:
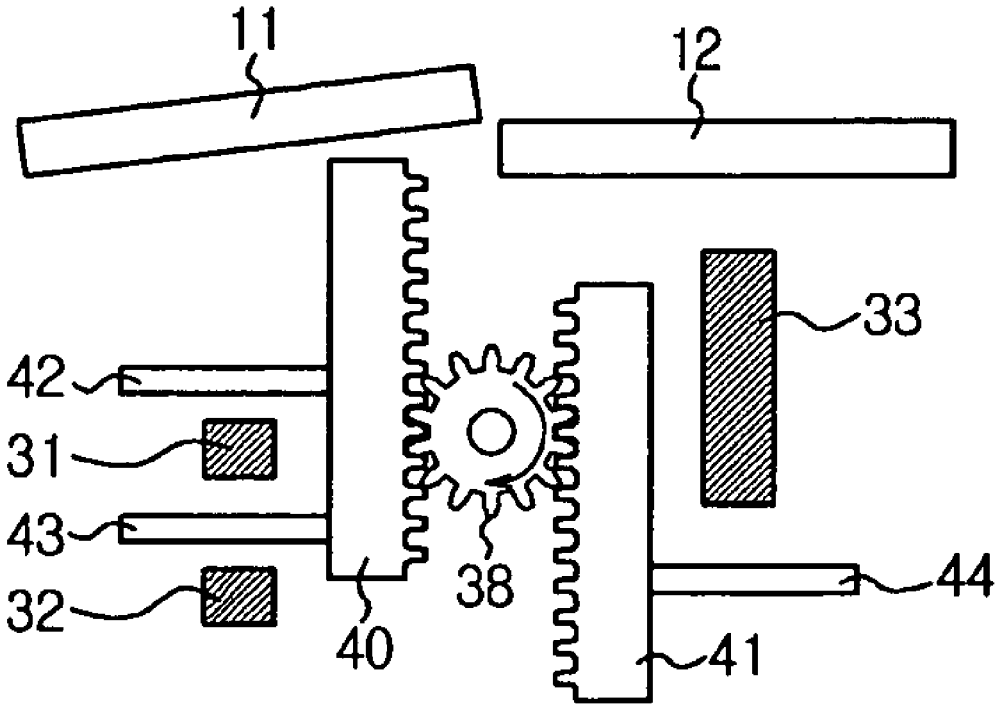
Figure 7C:
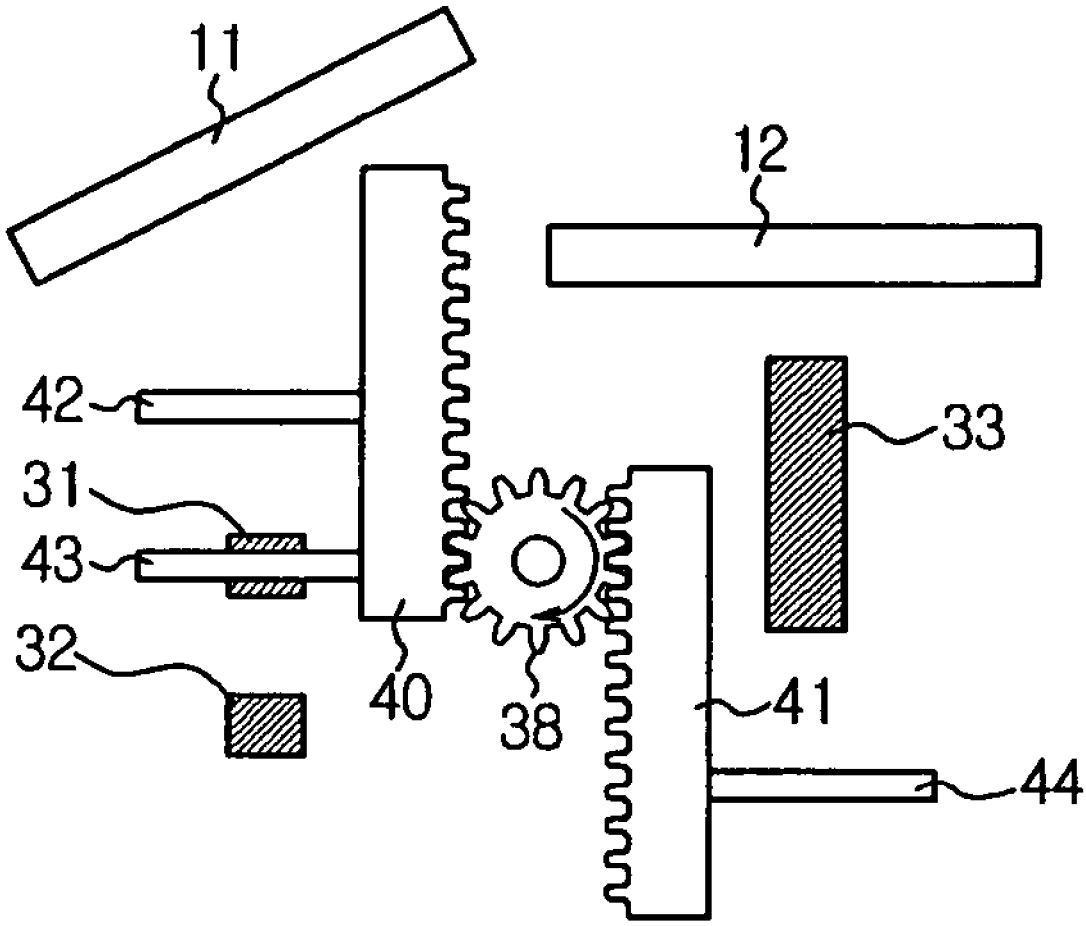

As shown in FIGS. 7B, 7C, and FIG. 8, if a user grasps or pulls a handle 15 of the first door 11 in order to open the first door 11, the motor 38 is driven with the manipulation of a second switch unit 17. In this case, as shown in FIG. 7B, since the motor 38 rotates in the first direction (clockwise) to push the sliding bar 40 forward, the door 11 is open. Further, when the first to third position detectors 31 to 33 do not detect the first to third protrusions 42 to 44 of the first and second sliding bars 40 and 41, the controller 30 recognizes an open state A of the first door 11.

As shown in FIG. 7C, when the motor 38 rotates in the first direction (clockwise) so that the first position detector 31 detects the second protrusion 43, and the second and third position detectors 32 and 33 do not detect any protrusions of the first and second sliding bars 40 and 41, the controller 30 recognizes a maximum open state A of the first door 11.

Figure 7D:
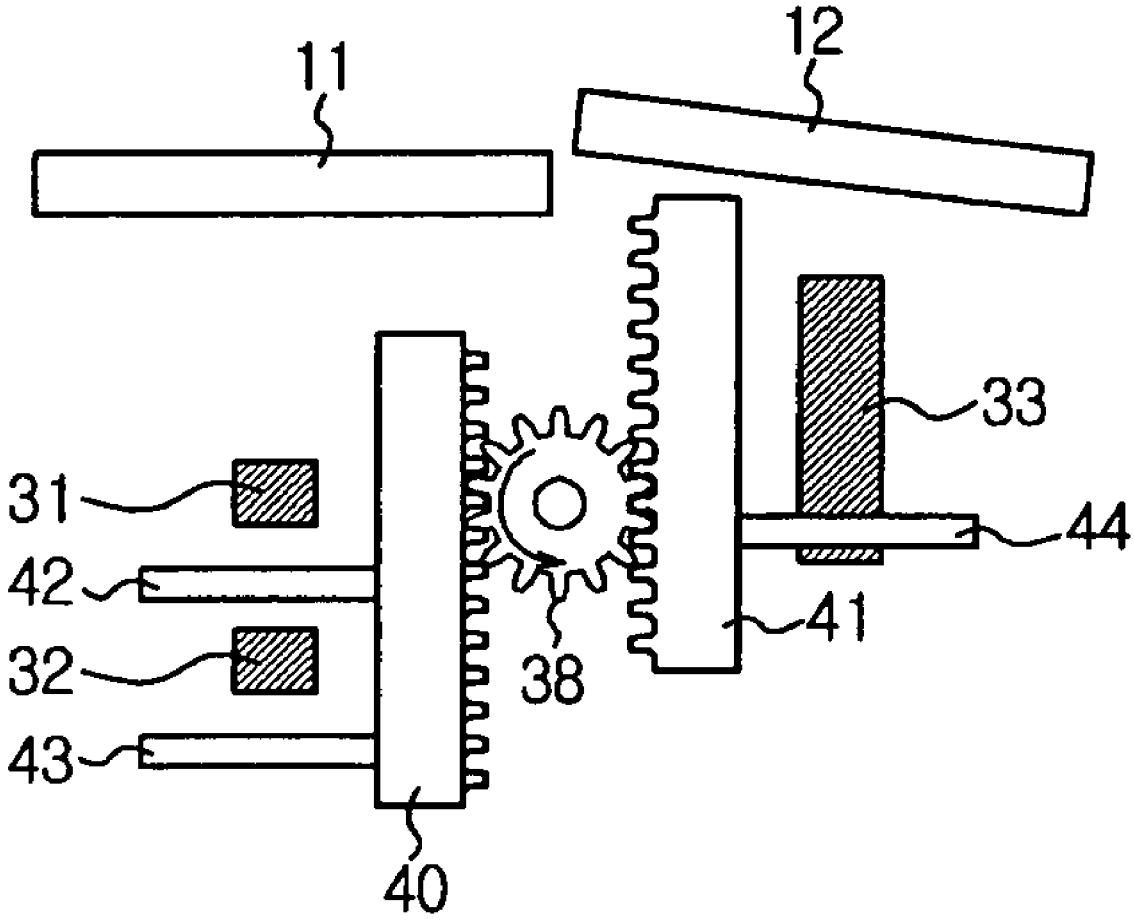
Figure 7E:
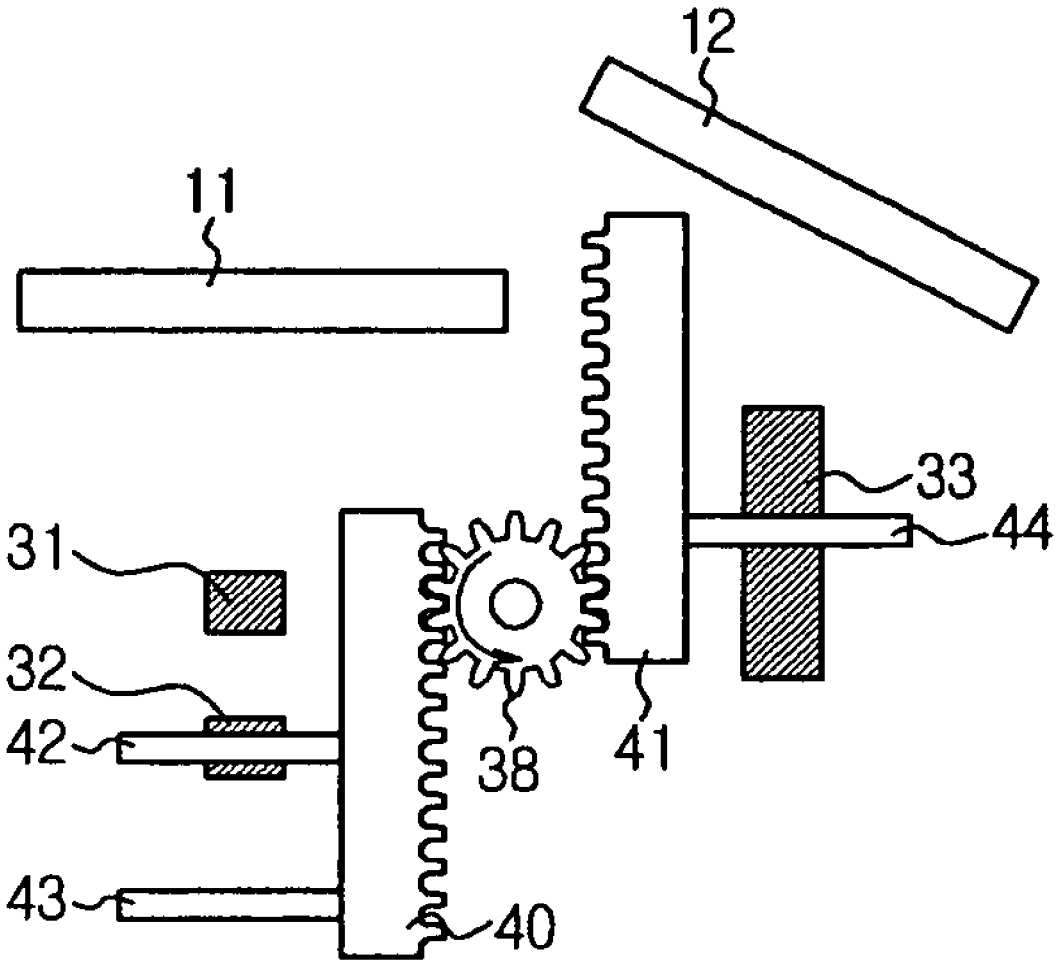

In addition, as shown in FIGS. 7D, 7E, and FIG. 8, if the user grasps or pulse a first handle 14 of the second door 12 in order to open the second door 12, the motor 38 is driven with the manipulation of a first switch unit 16. In this case, as shown in FIG. 7D, since the motor 38 rotates in the second direction (counterclockwise) to push the second sliding bar 41 forward, the second door 12 is open. Further, if the first and second position detectors 31 and 32 do not detect the first and second protrusions 42 and 43, and the third position detector 33 detects the third protrusion 44, the controller 30 recognizes the open state B of the second door 12.

In addition, as shown in FIG. 7E, the motor 38 rotates in the second direction (counterclockwise), so that the second and third position detectors 32 and 33 detect the first and third protrusions 42 and 44, and the first position detector 31 does not detect the second protrusion 43 of the sliding bar 40, the controller 30 recognizes the maximum open state A of the second door 12.

Figure 9:
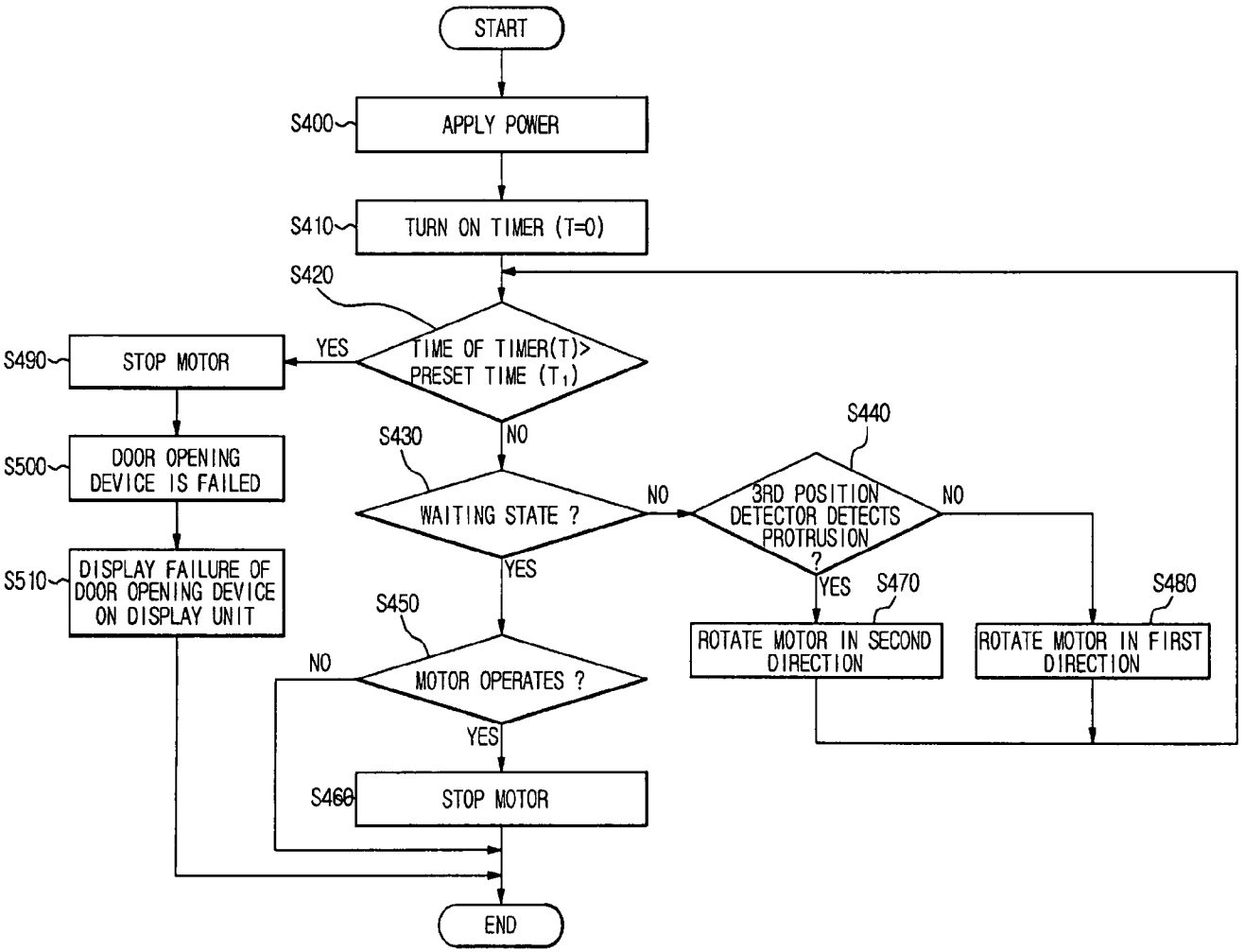
FIG. 9 is a flowchart showing an initialization operation of the door opening device upon a power-on state according to the second embodiment.

FIG. 9 is a flowchart showing an initialization operation of the door opening device 20 upon a power-on state according to the second embodiment.

As shown in FIG. 9, if the refrigerator is powered on, the controller 30 turns on a timer 35 to set a time T of the timer to 0 (operations S400 and S410).

Then, the controller 30 determines if the time T of the timer 35 exceeds a preset time T1. If the time T does not exceed the preset time T1, the controller 30 determines if the first and second doors 11 and 12 of the refrigerator are in the waiting state. In other words, the controller 30 determines if the first and second protrusions 42 and 43 of the first sliding bar 40 are detected by the first and second position detectors 31 and 32, and the third position detector 33 does not detect the protrusion 44, to determine the closed state of the first and second doors 11 and 12 (operations S420 and S430)

Next, if the controller 30 determines that both of the first and second doors 11 and 12 are in the waiting state when the refrigerator is powered on in operation S430, the controller 30 determines the operational state of the motor 38. Accordingly, if the motor 48 is operating, the controller 30 stops the rotation of the motor 38 and terminates the initialization operation. However, if the first and second doors 11 and 12 are in the waiting state when the refrigerator is powered on, since the motor 38 has been stopped, the initialization operation is instantly terminated (operations S450 and S460).

Meanwhile, the controller 30 determines that both of the first and second doors 11 and 12 of the refrigerator are not in the waiting state in operation S430, the controller 30 determines if the third protrusion 44 is detected by the third position detector 33. In other words, the controller 30 determines if the third protrusion 33 of the second sliding bar 41 is detected by the third position detector 44.

Thereafter, the controller 30 determines that the door 12 is open if the third protrusion 44 is detected by the third position detector 33 in operation S440, and rotates the motor 38 in the first direction (clockwise) to move the second sliding bar 41 such that the second door 12 is closed (operation S470).

Therefore, the controller 30 determines that the first door 11 is open if the third protrusion 44 is not detected by the third position detector 33, and rotates the motor 38 in the second direction (counterclockwise) to move the first sliding bar 40 such that the first door 11 is closed in operation S470. In other words, the controller 30 determines that the second door 12 is open if the third protrusion 44 is detected by the third position detector 33, and the first door 11 is open if the third protrusion 44 is not detected by the third position detector 33 according to the program stored in the memory 34. Accordingly, the controller 30 rotates the motor 38 such that the two first and second doors 11 and 12 are regulated to be closed, that is, be in the waiting state (operation S480).

If the motor 38 rotates in operations S470 to S480, the controller 30 returns to operation S420 to determine if the time T of the timer 35 exceeds the preset time T1. If the time T of the timer 35 does not exceed the time T1, the controller 30 repeats operations S430 to S440. In this case, if the first and second doors 11 and 12 do not reach the waiting state until the time T of the timer 35 exceeds the time T1, the controller 30 stops the motor 38, determines that the door opening device 20 is failed, and displays the failure of the door opening device 20 on the display unit 37 (operations S490 to S510).

However, if the first and second doors 11 and 12 reach the waiting state within the preset time T1 through the above procedure, the controller 30 determines the operational state of the motor 38 and then stops the motor 38, thereby terminating the initialization operation (operations S450 and S460).

Although few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

first and second doors which open/close first and second storage compartments defined in a body, respectively; and a door opening device, wherein the door opening device comprises a plurality of sliding bars which selectively directly push open the first and second doors; and a single motor connected to each of the plurality of sliding bars, when the motor rotates in a first direction, the motor allows a first sliding bar to move forward and a second sliding bar to move backward such that the first door is opened, and when the motor rotates in a second direction, the motor allows the first sliding bar to move backward and the second sliding bar to move forward such that the second door is opened.

2. The refrigerator of claim 1, wherein the door opening device further comprises a switch unit to input a door opening signal used to open the first door or the second door.

3. The refrigerator of claim 2, wherein the door opening device further comprises a controller to control the first door or the second door to be open according to the door opening signal input from the switch unit.

4. The refrigerator of claim 1, wherein the door opening device further comprises a plurality of position detectors to detect at least one protrusion provided at one side of the sliding bars.

5. The refrigerator of claim 4, wherein the door opening device further comprises a display unit to display failure of the door opening device.

* * * * *